US011468872B2

(12) United States Patent
Perdue

(10) Patent No.: US 11,468,872 B2
(45) Date of Patent: Oct. 11, 2022

(54) SOUND ABSORBING PANEL

(71) Applicant: Joab Jay Perdue, Amarillo, TX (US)

(72) Inventor: Joab Jay Perdue, Amarillo, TX (US)

( * ) Notice: Subject to any disclaimer, the term of this patent is extended or adjusted under 35 U.S.C. 154(b) by 0 days.

(21) Appl. No.: 17/224,106

(22) Filed: Apr. 6, 2021

(65) Prior Publication Data

US 2021/0350781 A1 Nov. 11, 2021

Related U.S. Application Data

(63) Continuation-in-part of application No. 17/163,727, filed on Feb. 1, 2021, now abandoned, and a continuation-in-part of application No. 15/655,850, filed on Jul. 20, 2017, now abandoned.

(51) Int. Cl.
*G10K 11/162* (2006.01)
*E04B 1/86* (2006.01)

(52) U.S. Cl.
CPC ..... *G10K 11/162* (2013.01); *E04B 1/86* (2013.01); *E04B 2103/04* (2013.01)

(58) Field of Classification Search
CPC ..... E04B 2103/04; E04B 1/86; G10K 11/162
USPC ..... 181/284
See application file for complete search history.

(56) References Cited

U.S. PATENT DOCUMENTS

| | | | | |
|---|---|---|---|---|
| 4,242,398 | A | 12/1980 | Segawa | |
| 5,644,872 | A * | 7/1997 | Perdue | E04B 1/86 181/284 |
| 6,158,176 | A * | 12/2000 | Perdue | E04B 1/86 181/284 |
| 6,443,257 | B1 * | 9/2002 | Wiker | B32B 29/00 181/290 |
| 7,565,951 | B1 * | 7/2009 | Perdue | E04B 1/86 181/284 |
| 10,344,410 | B2 | 7/2019 | Teragami | |
| 10,607,589 | B2 * | 3/2020 | Arvidson | B32B 5/145 |
| 2018/0038097 | A1 * | 2/2018 | Perdue | E04B 1/86 |
| 2020/0265820 | A1 * | 8/2020 | Perdue | G10K 11/162 |

* cited by examiner

*Primary Examiner* — Forrest M Phillips
(74) *Attorney, Agent, or Firm* — Shannon Warren

(57) ABSTRACT

A sound absorbing panel for managing acoustic environments with desired durability, stiffness and advantageous characteristics for self-supporting sound-absorbing panels intended to be attached to indoor walls and ceilings of buildings. The sound absorbing panel comprising a height, a width, a length and a cover. The sound absorbing panel comprising materials characterized by an inner core comprising a core density, a core binder and a thickness. The core density is between two and a half and four and a half pounds per cubic-foot. The core binder is between one and three-fourths and two and three fourths percent. The thickness comprises a thickness between 35-45 mm. The cover comprises a cover weight. The cover weight is between one quarter and one half ounces per foot.

10 Claims, 9 Drawing Sheets

PRIOR ART

300

| Technology (300a) | Core Density (lb/ft^3) (300b) | Core Binder (%) (300c) | Weight (oz/ft) (300d) | Thickness (mm) (300e) |
|---|---|---|---|---|
| Prior Art (302) | 6 - 8 | 3 - 5 | 3/4 - 3 | 20 - 30 |
| Current System (304) | 2.5 - 4.5 | 1.75 - 2.75 | 0.25 - 0.50 | 35 - 45 |

318

400
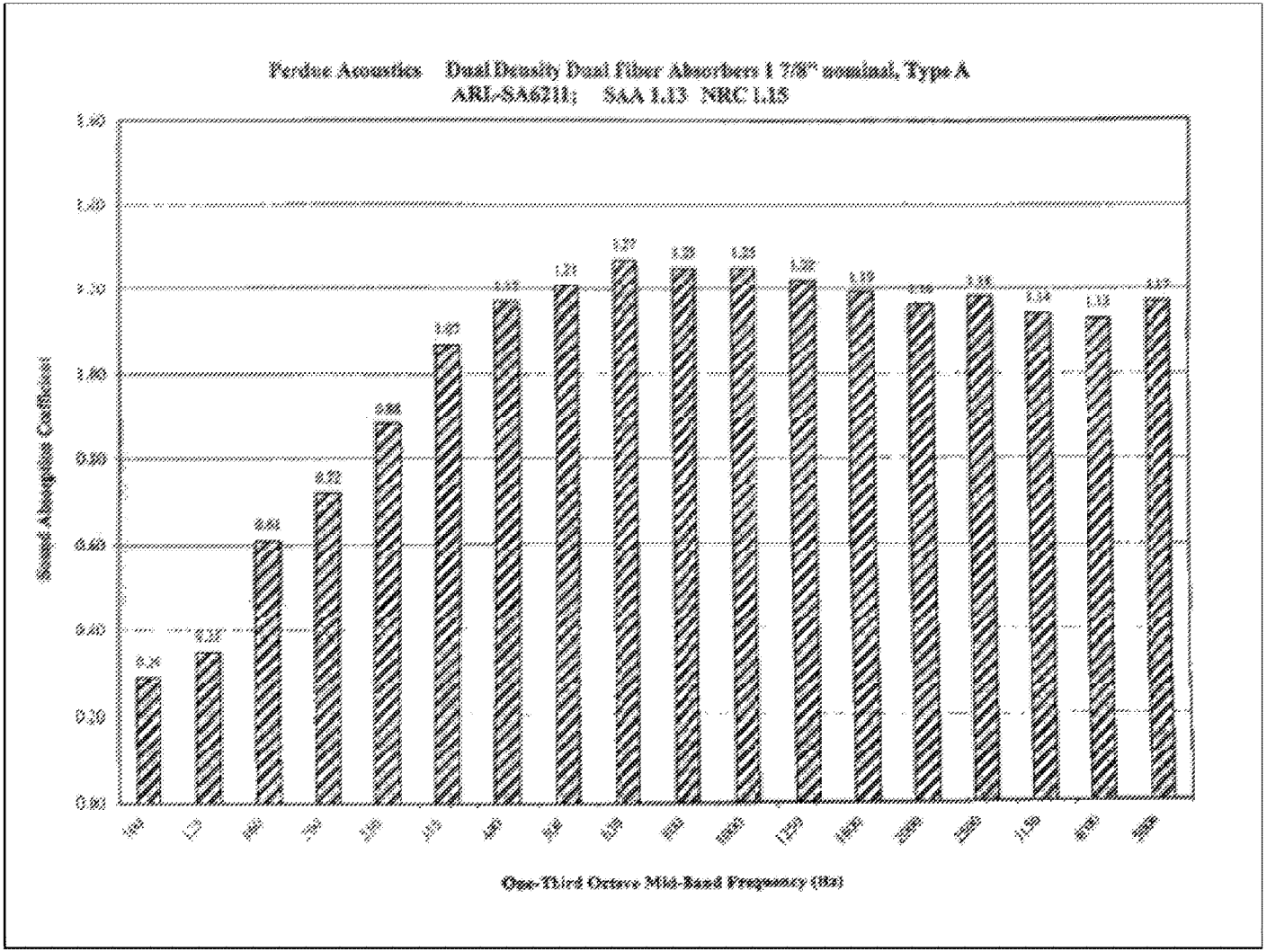
Perdue Acoustics Dual Density Dual Fiber Absorbent 1 7/8" nominal, Type A
ARL-SA6311; SAA 1.13 NRC 1.13
Sound Absorption Coefficient
1.00
0.90
0.80
0.70
0.60
0.50
0.40
0.30
0.20
0.10
0.00
0.26
0.37
0.60
0.72
0.85
0.97
1.01
1.01
1.01

500

600

700

702

| Frequency | Wiker Type E400 Test Result | 1997 Perdue | Current System |
|---|---|---|---|
| 100 | 0.44 | 0.13 | 0.29 |
| 125 | 0.42 | 0.46 | 0.35 |
| 160 | 0.45 | 0.57 | 0.64 |
| 200 | 0.45 | 0.62 | 0.72 |
| 250 | 0.53 | 0.93 | 0.88 |
| 315 | 0.63 | 1.09 | 1.07 |
| 400 | 0.88 | 1.23 | 1.17 |
| 500 | 1.00 | 1.26 | 1.21 |
| 630 | 0.97 | 1.22 | 1.27 |
| 800 | 0.74 | 1.15 | 1.25 |
| 1000 | 1.04 | 1.10 | 1.25 |
| 1250 | 1.09 | 1.08 | 1.22 |
| 1600 | 1.11 | 1.02 | 1.19 |
| 2000 | 1.08 | 1.00 | 1.16 |
| 2500 | 1.09 | 0.99 | 1.18 |
| 3150 | 1.06 | 1.00 | 1.14 |
| 4000 | 1.04 | 1.00 | 1.13 |
| 5000 | 1.03 | 1.00 | 1.17 |

FIG. 7B

SOUND ABSORBING PANEL

CROSS-REFERENCE TO RELATED APPLICATIONS

This application claims benefit to U.S. Patent Application Nos. 62/413,715 filed on Oct. 27, 2016, 62/364,315 filed on Jul. 20, 2016, Ser. No. 15/655,850 filed on Jul. 20, 2017, and Ser. No. 17/163,727 filed on Feb. 1, 2021.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

None of the known inventions and patents, taken either singularly or in combination, is seen to describe the instant disclosure as claimed. However, Applicant acknowledges the presence of his previous patent (U.S. Pat. No. 5,644,872 A, now expired) and treats the same as prior art for purposes of this application.

Likewise, these references were cited in one parent application to this filing and are disclosed hereafter and in the Information Disclosure Statement: U.S. Pat. Nos. 4,242,398A, 5,644,872A, 6,158,176A, 6,443,257B1, 9,243,401B2, and U.S. Pat. No. 10,344,410B.

This invention concerns self-supporting sound-absorbing panels intended to be attached to indoor walls and ceilings of buildings.

It is often sought to diminish the noise level in indoor rooms, auditoriums, gymnasiums, restaurants, hallways, manufacturing plants and other indoor areas. Various types of sound-absorbing rigid panel products have been employed as ceiling tiles, and various rigid and soft wall coverings have been disclosed for sound absorption.

In general, prior sound-absorbing materials have either been difficult to install or have been deficient with respect to fireproof characteristics. Panels have been fabricated of fiberglass batting for application to indoor room surfaces. Although fiberglass panels provide good thermal insulation, their acoustic absorption characteristics and aesthetic appearance are generally poor. Such panels are also easily susceptible to physical damage as a result of abrasion or impact, as by a ball.

Products made of "rockwool", sometimes called "mineral wool," have been employed in the building industry in the form of loose batting used for thermal insulation. Rockwool is generally produced by the centrifugal spinning of molten mineral magna. The resultant fibers, unlike fiberglass fibers, are of indeterminate length, and are intermingled as a loose batting resulting from their manner of production.

Batting products, whether of fiberglass or rockwool can have various bulk densities, depending upon the degree of compaction of the fibers, the specific gravity of the fibers, and the amount of binder which may be employed to impart dimensional stability to the structure. When the batting is formed into a shape-retaining self-supporting structure, that structure is often referred to as a mat or panel.

It is accordingly an object of the present invention to provide a panel product that can be applied to flat indoor surfaces to achieve sound absorption.

It is a further object of this invention to provide a self-supporting panel as in the foregoing object having a rectangular configuration which enables a multitude of the panels to be placed in abutting relationship to cover a wall surface.

It is another object of the present invention to provide a panel of the aforesaid nature improved with respect to aesthetic appearance, resistance to physical damage and fire-resistance.

It is a still further object of this invention to provide a panel of the aforesaid nature of simple construction amenable to low cost manufacture.

These and other beneficial objects and advantages will be apparent from the following description.

A background in NRC and STC will be helpful in distinguishing the current system from the prior art.

Sound Transmission Class (STC) refers to acoustic energy transferring between spaces (how much sound gets out of the room to adjoining rooms) and Noise Reduction Coefficient (NRC) refers to acoustics within rooms (how much and how long the sound bounces around within a space). STC and NRC refer to two completely different worlds of acoustics, and they require two completely different lines of products to treat each one.

With reference to U.S. Pat. No. 6,443,257, with the applicant name "Wilker", note: Wilker's NRC solution would be ineffective for STC purpose because it is not designed for sound absorption.

When a room is echoing or excessively reverberant, it is considered loud, boomy, indistinct, or distorted. In fact, most professional acousticians consider a reverberation time of more than two seconds in large rooms (over 1,000 seats) and a reverberation time of more than one second in conference rooms to be excessive, and it is at this point that diction of the voice and overall clarity are lost. Therefore, even when maximum reverberation is desired it should not exceed two seconds. A simple test can be given to indicate the reverberation time of a room; shout or clap very loudly and see how long it takes for the sound to go away.

There are specific formulas that tell how much of a certain absorptive material is needed to reduce the reverberation in a room to a specified reverberation time. Clarity, intelligibility, and the ability to understand what's being said are lost proportionally as reverberation time rises in any case. There is no such thing as a highly reverberant room that retains clarity.

While reverberation times are limited, it is the job of a good acoustical treatment to eliminate all echoes as well. We will discuss the difference between echo and reverberation and how they affect intelligibility later. Adding acoustical treatment is the only way to eliminate echo and negate reverberation in a room, restoring clarity and understanding.

Sound Transmission Class problems are altogether different. STC simply refers to how much sound is transmitted from one room or area to the next. This problem is found throughout the working environment.

These sound transmission problems cannot be treated using acoustical wall panels within a room. In an STC situation, cinder block walls filled with sand or double studded sheet rock walls with insulation woven in between become more important in initial construction than anything that can be done after the fact.

Illustration of STC vs NRC

Imagine, for a moment, you are picking up a teenager at high school. Most kids are driving. As you sit in your modern vehicle with all the windows rolled up tight, you hear them yelling their goodbyes, honking at each other, revving their engines, etc., but it's not really all that loud inside the car. Now, in your imagination, reach over and roll down the window just a half of an inch. Wow! The outside noise comes rolling in! Everything else stayed the same. The same insulation, the same sheet metal, the same glass all around you. All you did was just roll one window, any one window, down a half an inch and all the outside commotion came roaring into your car. That's STC and how it works or doesn't work! In STC, what's around you is only as good as its weakest 'link'.

Sound takes the path of least resistance, so even the best built wall can have sound transmission problems if the door is not sealed correctly or the room has a drop ceiling and the wall does not go all the way to the roof deck (in this case, sound from one room goes up through the thin ceiling tiles over the wall and down into adjoining rooms). However, there are some helpful hints if the facility is already well past the construction phase.

The cheapest and best fix is to blow insulation into the ceiling as thickly as possible, or add blanket-type insulation tightly packed, eliminating voids. Another way to fix STC issues is to carry the walls up to the building's roof deck. After construction, this can be hard to do in some cases, but it may still be possible. It is also very important to address air vents and ducts. Special duct silencers are available, and board insulation can be used to line the last 2' to 3' inside of the ducts before the air enters or exits the room. Weather stripping around doors and windows, as though they are doors to the outside elements, also helps to seal the room and further eliminate STC problems.

BRIEF SUMMARY OF THE INVENTION

A sound absorbing panel for managing acoustic environments with desired durability, stiffness and advantageous characteristics for self-supporting sound-absorbing panels intended to be attached to indoor walls and ceilings of buildings. Said sound absorbing panel comprising a height, a width, a length and a cover. Said sound absorbing panel comprising materials characterized by an inner core comprising a core density, a core binder and a thickness. Said core density is between two and a half and four and a half pounds per cubic-foot. Said core binder is between one and three-fourths and two and three fourths percent. Said thickness comprises a thickness between 35-45 mm. Said cover comprises a cover weight. Said cover weight is between one quarter and one half ounces per foot. the combination of said core density and said core binder provides said inner core of said sound absorbing panel with enough impact resistance and edge detail to mount said sound absorbing panel without a frame without said sound absorbing panel sagging.

Said sound absorbing panel for managing acoustic environments with desired durability, stiffness and advantageous characteristics for self-supporting sound-absorbing panels intended to be attached to indoor walls and ceilings of buildings. Said sound absorbing panel comprising said height, said width, said length and said cover. Said sound absorbing panel comprising materials characterized by said inner core comprising said core density, said core binder and said thickness. Said core density is between two and a half and four and a half pounds per cubic-foot. Said core binder is between one and three-fourths and two and three fourths percent. Said thickness comprises a thickness between 35-45 mm.

Said sound absorbing panel for managing acoustic environments with desired durability, stiffness and advantageous characteristics for self-supporting sound-absorbing panels intended to be attached to indoor walls and ceilings of buildings. Said sound absorbing panel comprising said height, said width, said length and said cover. Said sound absorbing panel comprising materials characterized by said inner core comprising said core density, said core binder and said thickness. Said core density is between two and a half and six pounds per cubic-foot. Said core binder is between one and three-fourths and two and three fourths percent. Said thickness comprises a thickness between 35-45 mm.

BRIEF DESCRIPTION OF THE SEVERAL VIEWS OF THE DRAWING

FIG. 4B illustrates a panel test results chart 400.

FIGS. 7A, and 7B illustrate a comparison chart 700 and a comparison table 702.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
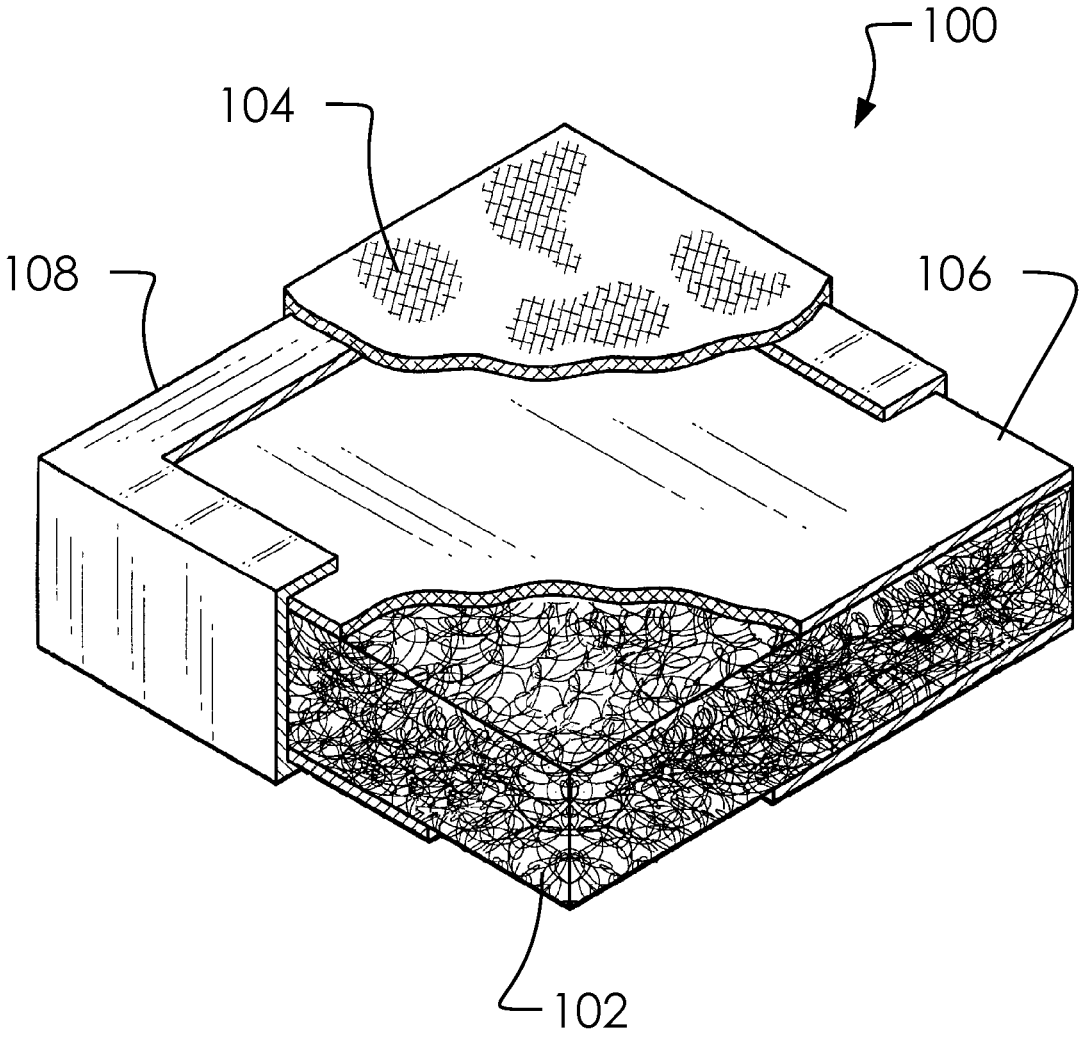
FIG. 1 illustrates a perspective overview view of a prior art panel 100.

FIG. 1 illustrates a perspective overview view of a prior art panel 100.

In one embodiment, said prior art panel 100 can comprise a Rockwool core 102, a cloth facing 104, a front sheet 106 and a frame 108.

This disclosure sets out to establish that the new system comprises (1) an improvement in durability, (2) keeps a firm edge, (3) has an improved sag resistance characteristics, and (4) that it does not need a frame. It also has proven, better sound absorption, better fire protection qualities, and can be used in a wide range of products regardless of shape or dimension.

Said prior art panel 100 can comprise an original core design for the Applicant and was a "framed" core. At that time, the Applicant had not yet perfected his product to the point of being able to create an absorber panel that was solid enough, had little enough sag, had great enough impact resistance and edge detail to do an unframed absorber. Said prior art panel 100 has undergone such an evolution over the years that no one thing was done at any one time, but the final outcome of a sound absorbing panel 200 is different in nearly every parameter from said prior art panel 100.

As is known in the art, said prior art panel 100 can comprise said Rockwool core 102 for sound absorption, said cloth facing 104 for containment of said Rockwool core 102, said front sheet 106 on one or more faces of said Rockwool core 102, said frame 108 for provision of stiffness and mounting of said prior art panel 100. Said prior art panel 100 is well-known but does have shortcomings. First, said Rockwool core 102 can have a flat front and rear surfaces and four substantially straight perimeter edges. As discussed below, said Rockwool core 102 can comprise a density between 5 and 9 pounds per cubic foot and a thickness between 0.75 and 2.0 inches.

These specifications were originally disclosed and claimed based on the observation that at densities below 5 lbs./cubic feet., the mat has insufficient rigidity to be useful in acoustic panels; whereas, at densities greater than 9 lbs./cubic feet., the mat provides insufficient sound absorption in acoustic panels. Further, the thickness of the Rockwool mat should be at least 0.75 inch in order to provide adequate sound absorption. Thicknesses greater than two inches did not afford significant further sound absorption, and had been found to cause bulging in the center of large panels.

It was further disclosed that although said Rockwool core 102 may be directly adhered to wall or ceiling surfaces for sound attenuation purposes, the cores are preferably converted into panels by way of the addition of said frame 108 and said front sheet 106 (a decorative fabric cover). Wherein, said frame 108 could be disposed about said Rockwool core 102. Said frame 108 may be made of metal or plastic and said front sheet 106 may be attached to said Rockwool core 102 with adhesive.

Figure 2:
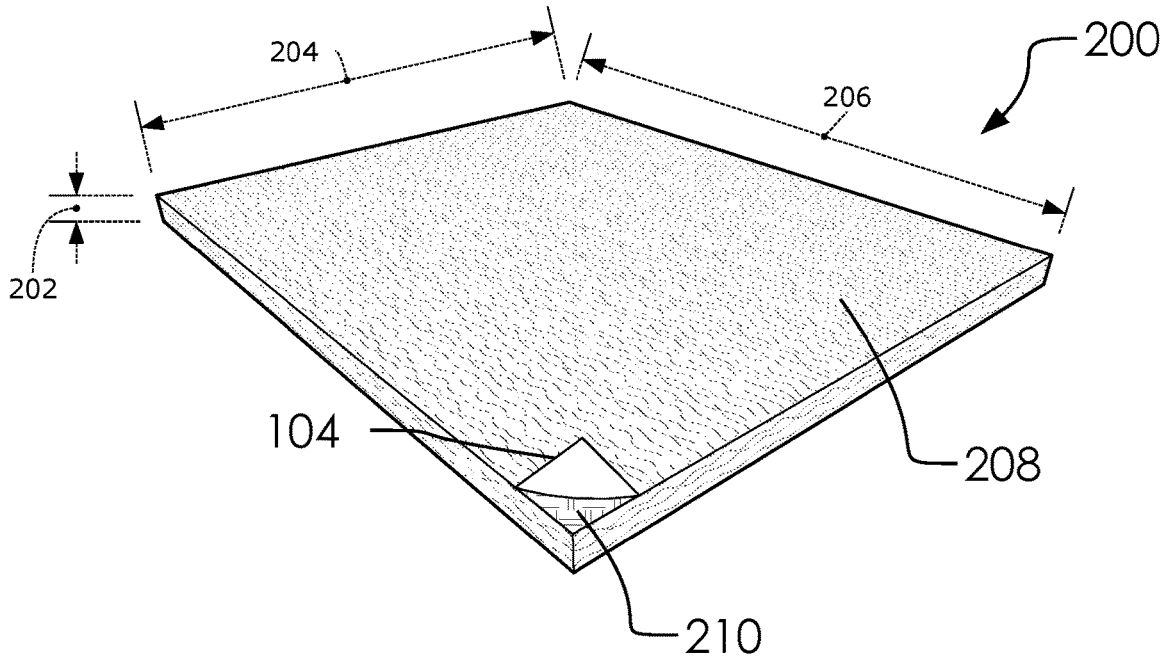
FIG. 2 illustrates a perspective overview view of a sound absorbing panel 200.

FIG. 2 illustrates a perspective overview view of said sound absorbing panel 200.

In one embodiment, said sound absorbing panel 200 can comprise a height 202, a width 204, a length 206 and a cover 208.

One objective of said sound absorbing panel 200 is to produce a sound-absorbing acoustic panel suitable for mounting upon a wall or ceiling of a room.

As with said prior art panel 100, said sound absorbing panel 200 can comprise said cloth facing 104 (hereafter referred to as said cover 208), and an inner core 210.

Figures 3A, 3B:
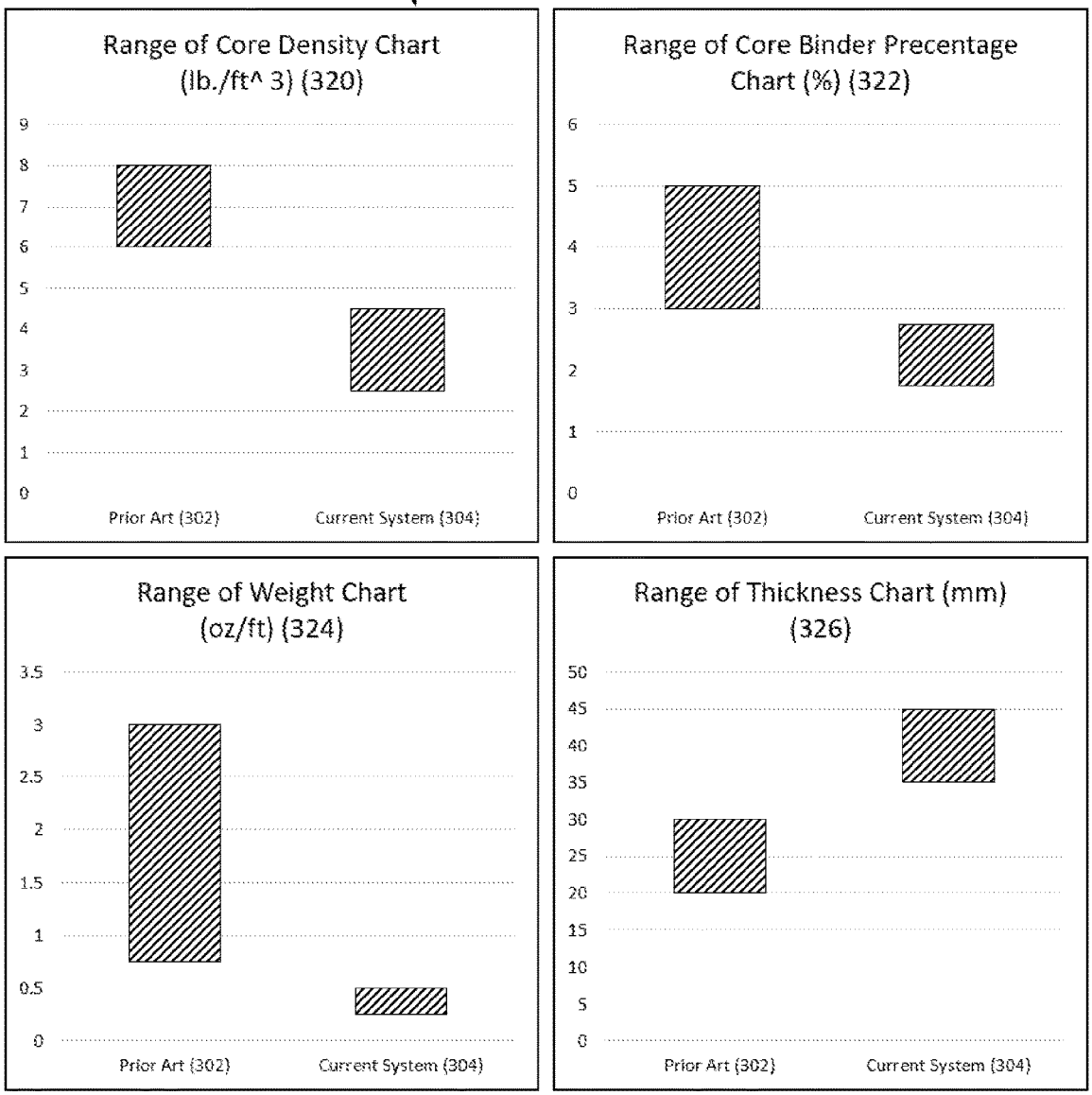
FIG. 3A illustrates view of a materials properties table 300.
FIG. 3B illustrates view of a four charts 318.

FIG. 3A illustrates view of a materials properties table 300. FIG. 3B illustrates view of a four charts 318.

In one embodiment, said materials properties table 300 can comprise a technology description 300*a*, a core density 300*b*, a core binder 300*c*, a cover weight 300*d*, a thickness 300*e*, a prior art characteristics 302 and a current system characteristics 304.

In one embodiment, said four charts 318 can comprise a range of core density chart 320, a range of core binder percentage chart 322, a range of mat weight chart 324 and a range of mat thickness chart 326.

In one embodiment, said materials properties table 300 can compare said prior art characteristics 302 to said current system characteristics 304. In one embodiment, said prior art characteristics 302 can comprise a range of specifications for well-known panels and are characterized as "prior art" here. In one embodiment, said current system characteristics 304 can comprise a range of characteristics of said sound absorbing panel 200, disclosed herein.

In one embodiment, said core density 300*b*, said core binder 300*c*, said cover weight 300*d* and said thickness 300*e* can describe properties of said inner core 210 and/or said cover 208 of said sound absorbing panel 200.

In one embodiment, said current system characteristics 304 can comprise said core density 300*b* between two and a half to four and half (2.5-4.5) pounds per cubic foot; said core binder 300*c* can comprise one and three quarters to two and three quarters (1.75-2.75) percentage binder; said cover weight 300*d* can comprise one quarter to one half (0.25-0.50) ounces per foot; said thickness 300*e* can comprise thirty-five to forty-five (35-45) mm.

It is noted that said sound absorbing panel 200 provides both said inner core 210 (as to density and binder percentage), and a lighter yet thicker mat. These properties can be enabled by the inclusion of said inner core 210 which provides ample stiffness and allows other parts of said sound absorbing panel 200 to function according to desired acoustical characteristics.

Additional advancements of said sound absorbing panel 200 can comprise an improved fire rating. By using less binder said sound absorbing panel 200 can limit or eliminate the use of resins (such as phenolic resins); wherein, removing these resins can cause said sound absorbing panel 200 to be more fire resistant that said prior art panel 100 or similar prior art.

Accordingly, said sound absorbing panel 200 has been shown to be an improvement over said prior art panel 100, or prior art in general, in that it is lighter, fire resistant, simpler to manufacture, and can take on new forms for purposes of mounting said sound absorbing panel 200 (as illustrated and discussed below).

In one embodiment, preferred embodiment, said core density 300*b* can comprise 4.5 pounds per cubic foot; said core binder 300*c* can comprise 2.4 percent; said cover weight 300*d* can comprise 0.375 ounces/foot.

Figure 4A:
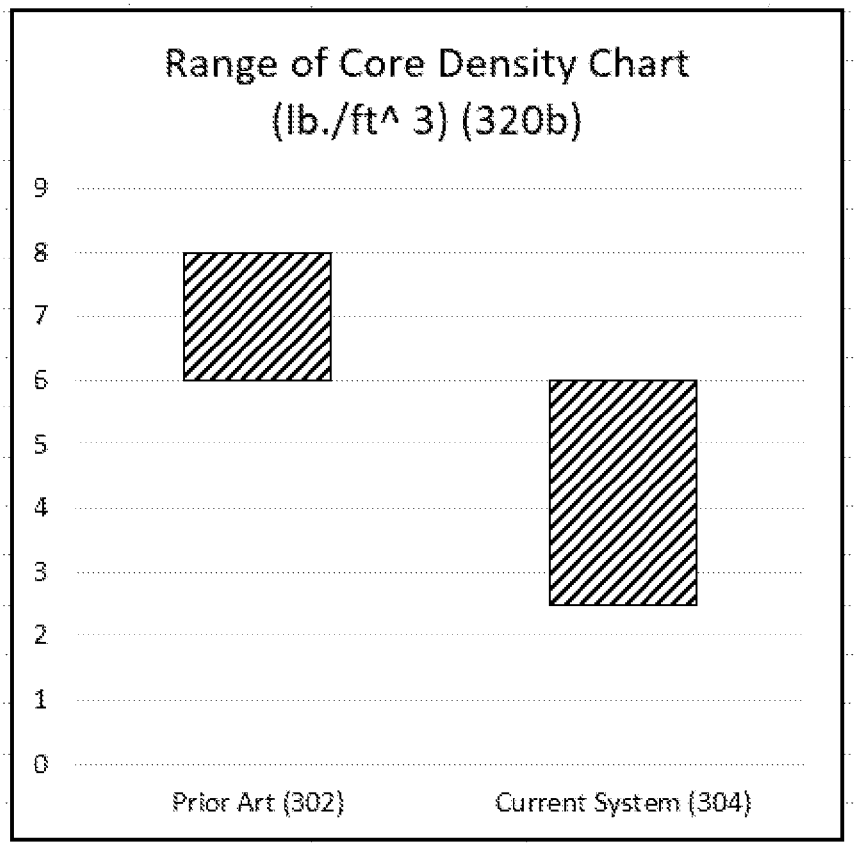
FIG. 4A illustrates a range of core density chart 320*b*.

FIG. 4A illustrates a range of core density chart 320*b*.

In one embodiment, said core density 300*b* can comprise a range of 2.5-6.0 pounds per cubic foot, as illustrated in said range of core density chart 320*b*. In one preferred embodiment, said core density 300*b* can comprise approximately 6.0 pounds per cubic foot.

FIG. 4B illustrates a panel test results chart 400.

Said panel test results chart 400 comprises an acoustic test results for said sound absorbing panel 200. This test is several years old and represents an internal test by the Applicant. It is noted that FIGS. 4B-6 will be discussed below in comparison to the prior art.

Figure 5:
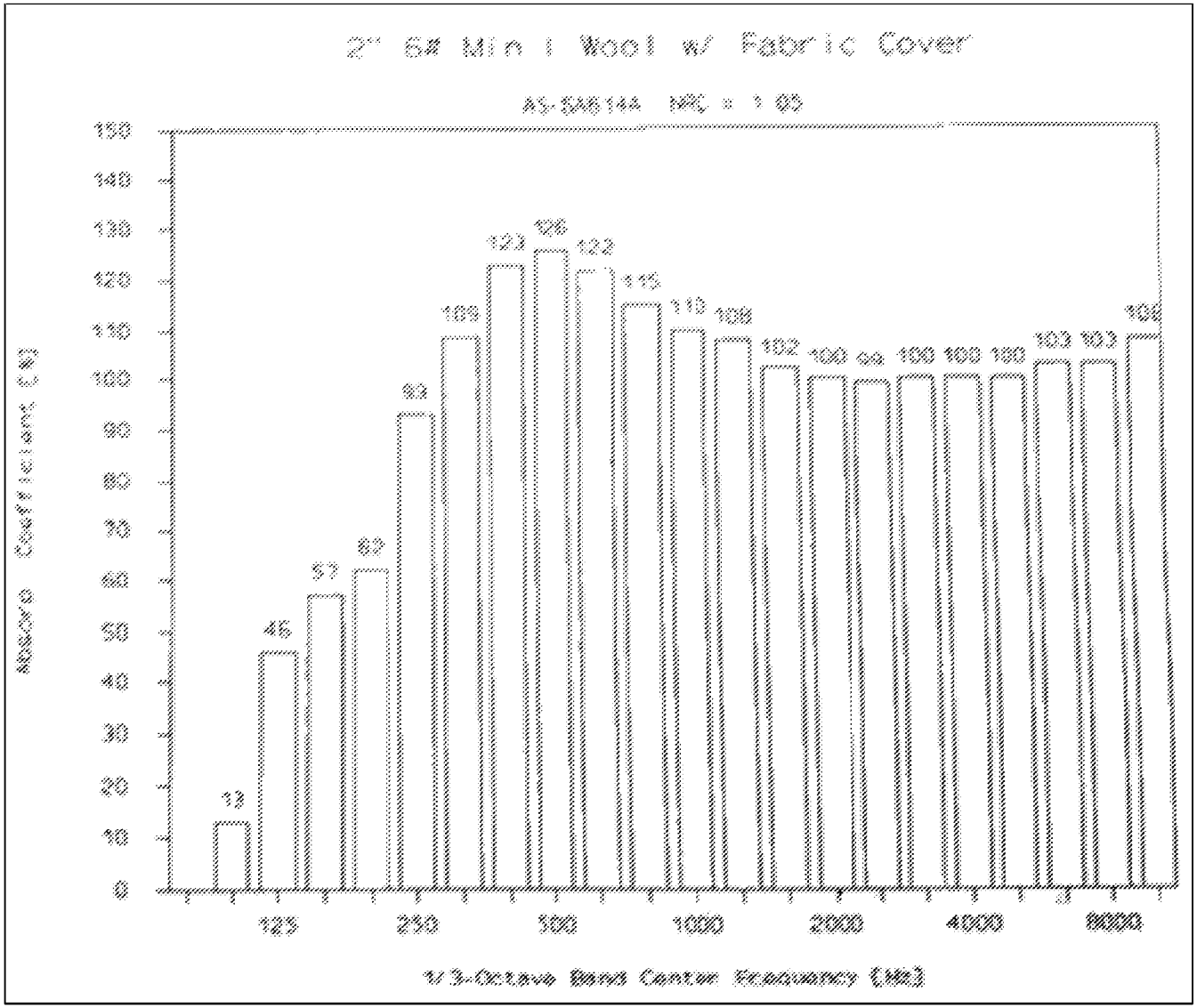
FIG. 5 illustrates a 1997 panel test results chart 500.

FIG. 5 illustrates a 1997 panel test results chart 500.

Said 1997 panel test results chart 500 can comprise a panel developed by the Applicant in 1997.

Figure 6:
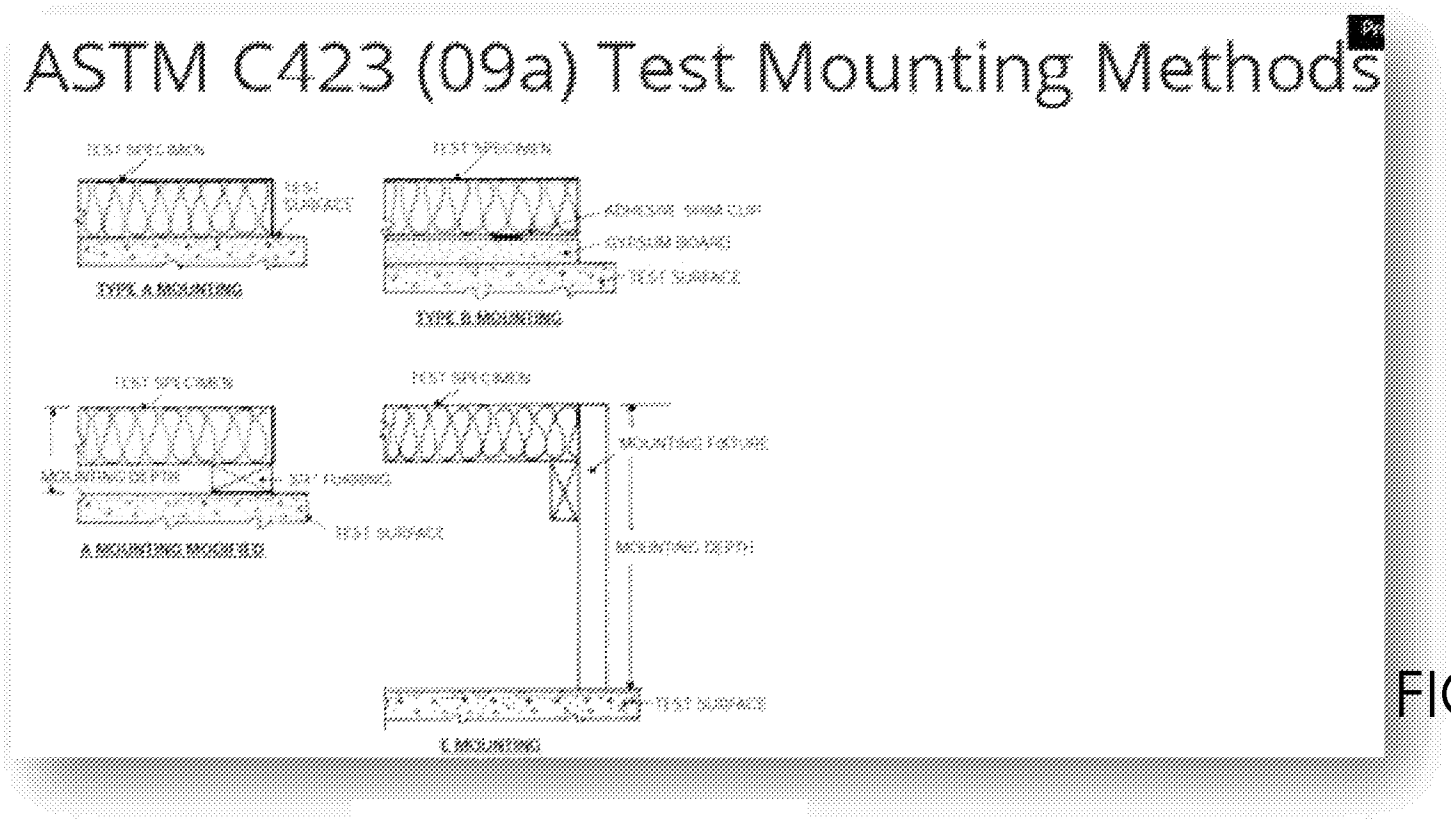
FIG. 6 illustrates a testing mounts diagram 600; wherein, cores were 1.05 at 2" thickness in a class A test just like this new one at 1.15 at 1⅞" thickness designated "Dual Density Dual Fiber Absorbers".

FIG. 6 illustrates a testing mounts diagram 600; wherein, cores were 1.05 at 2" thickness in a class A test just like this new one at 1.15 at 1⅞" thickness designated "Dual Density Dual Fiber Absorbers".

Figure 7A:
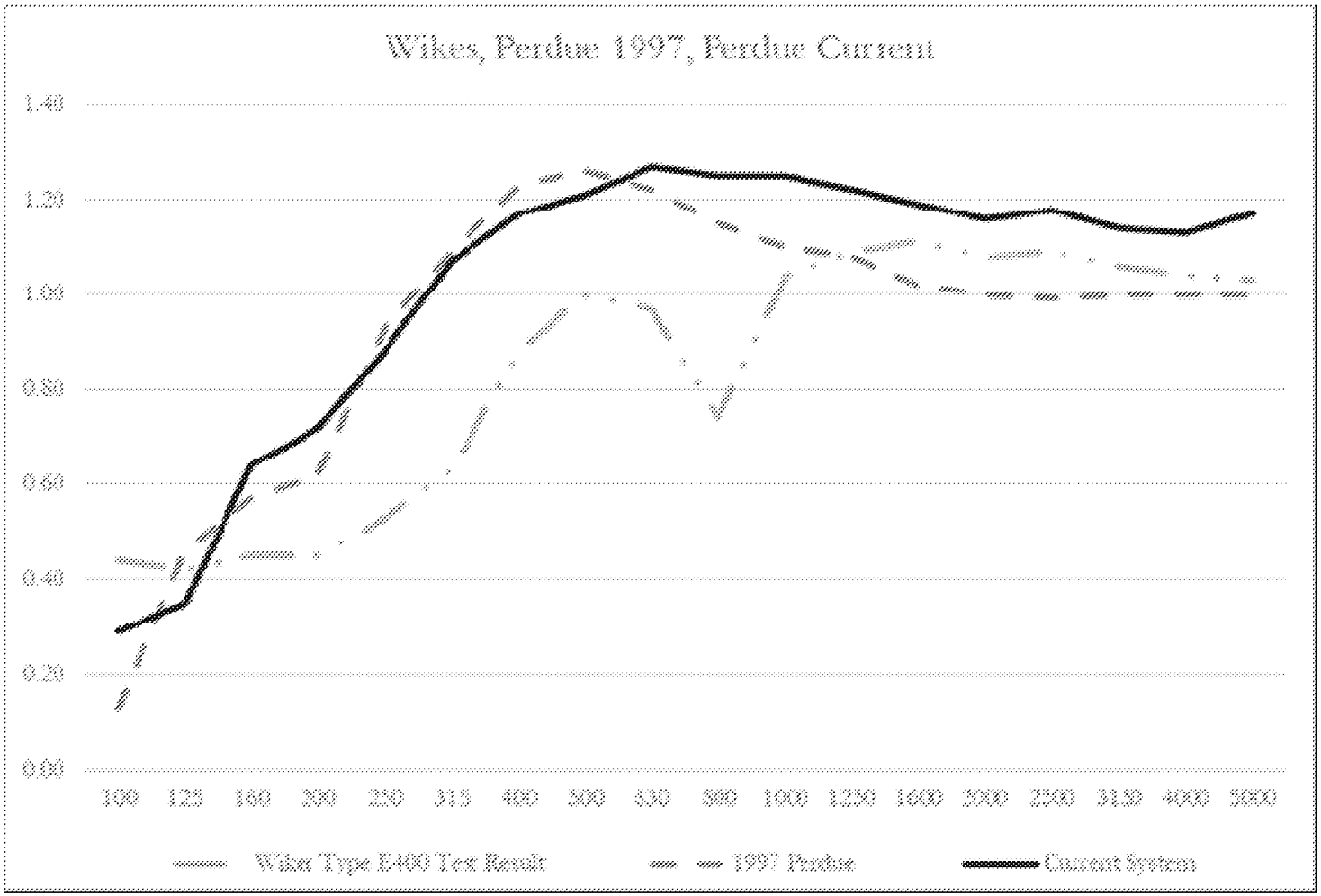

FIGS. 7A, and 7B illustrate a comparison chart 700 and a comparison table 702.

Referring now to prior art cited in the parent application to this filing, the second column of said comparison table

702 discusses test results seen in the type of panel disclosed by Applicant Wilker in patent U.S. Pat. No. 6,443,257. These results likely benefit from a boost in absorption due to using a Type E400 testing method (see said testing mounts diagram 600). Whereas, said sound absorbing panel 200 was tested on the more stringent Type A test. Even so, please note the significant improvement in performance shown in said comparison chart 700 in the fourth column.

These parts are illustrated in the figures and discussed below:

said prior art panel 100,
said Rockwool core 102,
said cloth facing 104,
said front sheet 106,
said frame 108,
said sound absorbing panel 200,
said height 202,
said width 204,
said length 206,
said cover 208,
said materials properties table 300,
said technology description 30*a*,
said core density 300*b*,
said core binder 300*c*,
said cover weight 300*d*,
said thickness 300*e*,
said prior art characteristics 302,
said current system characteristics 304,
said four charts 318,
said range of core density chart 320,
said range of core binder percentage chart 322,
said range of mat weight chart 324 and
said range of mat thickness chart 326.

The following sentences are included for completeness of this disclosure with reference to the claims.

Said sound absorbing panel 200 for managing acoustic environments with desired durability, stiffness and advantageous characteristics for self-supporting sound-absorbing panels intended to be attached to indoor walls and ceilings of buildings. Said sound absorbing panel 200 comprising said height 202, said width 204, said length 206 and said cover 208. Said sound absorbing panel 200 comprising materials characterized by said inner core 210 comprising said core density 300*b*, said core binder 300*c* and said thickness 300*e*. Said core density 300*b* can be between two and a half and four and a half pounds per cubic-foot. Said core binder 300*c* can be between one and three-fourths and two and three fourths percent. Said thickness 300*e* comprises a thickness between 35-45 mm. Said cover 208 comprises said cover weight 300*d*. Said cover weight 300*d* can be between one quarter and one half ounces per foot. the combination of said core density 300*b* and said core binder 300*c* provides said inner core 210 of said sound absorbing panel 200 with enough impact resistance and edge detail to mount said sound absorbing panel 200 without a frame without said sound absorbing panel 200 sagging.

Said sound absorbing panel 200 for managing acoustic environments with desired durability, stiffness and advantageous characteristics for self-supporting sound-absorbing panels intended to be attached to indoor walls and ceilings of buildings. Said sound absorbing panel 200 comprising said height 202, said width 204, said length 206 and said cover 208. Said sound absorbing panel 200 comprising materials characterized by said inner core 210 comprising said core density 300*b*, said core binder 300*c* and said thickness 300*e*. Said core density 300*b* can be between two and a half and four and a half pounds per cubic-foot. Said core binder 300*c* can be between one and three-fourths and two and three fourths percent. Said thickness 300*e* comprises a thickness between 35-45 mm.

Said cover 208 comprises said cover weight 300*d*. Said cover weight 300*d* can be between one quarter and one half ounces per foot.

Said inner core 210 comprises Rockwool.

the combination of said core density 300*b* and said core binder 300*c* provides said inner core 210 of said sound absorbing panel 200 with enough impact resistance and edge detail to mount said sound absorbing panel 200 without a frame without said sound absorbing panel 200 sagging.

Said sound absorbing panel 200 for managing acoustic environments with desired durability, stiffness and advantageous characteristics for self-supporting sound-absorbing panels intended to be attached to indoor walls and ceilings of buildings. Said sound absorbing panel 200 comprising said height 202, said width 204, said length 206 and said cover 208. Said sound absorbing panel 200 comprising materials characterized by said inner core 210 comprising said core density 300*b*, said core binder 300*c* and said thickness 300*e*. Said core density 300*b* can be between two and a half and six pounds per cubic-foot. Said core binder 300*c* can be between one and three-fourths and two and three fourths percent. Said thickness 300*e* comprises a thickness between 35-45 mm.

Said cover 208 comprises said cover weight 300*d*. Said cover weight 300*d* can be between one quarter and one half ounces per foot.

Said inner core 210 comprises Rockwool.

Said cover 208 comprises said cover weight 300*d*. Said cover weight 300*d* can be between one quarter and one half ounces per foot. Said inner core 210 comprises Rockwool.

the combination of said core density 300*b* and said core binder 300*c* provides said inner core 210 of said sound absorbing panel 200 with enough impact resistance and edge detail to mount said sound absorbing panel 200 without a frame without said sound absorbing panel 200 sagging.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A sound absorbing panel for managing acoustic environments with desired durability, stiffness and advantageous characteristics for self-supporting sound-absorbing panels intended to be attached to indoor walls and ceilings of buildings, wherein:

said sound absorbing panel comprising a height, a width, a length and a cover;

said sound absorbing panel comprising materials characterized by an inner core comprising a core density, a core binder and a thickness;

said core density is between two and a half and four and a half pounds per cubic-foot;

said core binder is between one and three-fourths and two and three fourths percent;

said thickness comprises a thickness between 35-45 mm;

said cover comprises a cover weight;

said cover weight is between one quarter and one half ounces per foot; and the combination of said core density and said core binder provides said inner core of said sound absorbing panel with enough impact resistance and edge detail to mount said sound absorbing panel without a frame without said sound absorbing panel sagging.

2. A sound absorbing panel for managing acoustic environments with desired durability, stiffness and advantageous characteristics for self-supporting sound-absorbing panels intended to be attached to indoor walls and ceilings of buildings, wherein:

said sound absorbing panel comprising a height, a width, a length and a cover;

said sound absorbing panel comprising materials characterized by an inner core comprising a core density, a core binder and a thickness;

said core density is between two and a half and four and a half pounds per cubic-foot;

said core binder is between one and three-fourths and two and three fourths percent; and said thickness comprises a thickness between 35-45 mm.

3. The sound absorbing panel of claim 2, wherein:

said cover comprises a cover weight; and said cover weight is between one quarter and one half ounces per foot.

4. The sound absorbing panel of claim 2, wherein:

said inner core comprises Rockwool.

5. The sound absorbing panel from claim 2, wherein:

the combination of said core density and said core binder provides said inner core of said sound absorbing panel with enough impact resistance and edge detail to mount said sound absorbing panel without a frame without said sound absorbing panel sagging.

6. A sound absorbing panel for managing acoustic environments with desired durability, stiffness and advantageous characteristics for self-supporting sound-absorbing panels intended to be attached to indoor walls and ceilings of buildings, wherein:

said sound absorbing panel comprising a height, a width, a length and a cover;

said sound absorbing panel comprising materials characterized by an inner core comprising a core density, a core binder and a thickness;

said core density is between two and a half and six pounds per cubic-foot;

said core binder is between one and three-fourths and two and three fourths percent; and said thickness comprises a thickness between 35-45 mm.

7. The sound absorbing panel of claim 6, wherein:

Said cover comprises said cover weight; and

Said cover weight is between one quarter an one half ounces per foot.

8. The sound absorbing panel of claim 6, wherein:

Said inner core comprises Rockwool.

9. The sound absorbing panel of claim 6, wherein:

Said cover comprises said cover weight;

Said cover weight is between one quarter and one half ounces per foot; and

Said inner core comprises Rockwool.

10. The sound absorbing panel of claim 6, wherein:

The combination of said core density and said core binder provided said inner core of said sound absorbing panel with enough impact resistance and edge detail to mount said sound absorbing panel without a frame without said sound absorbing panel sagging.

* * * * *